US006676092B2

(12) United States Patent
Tsai

(10) Patent No.: US 6,676,092 B2
(45) Date of Patent: Jan. 13, 2004

(54) SIZE ADJUSTABLE TRASH BAG HOLDER

(76) Inventor: Bi-Hau Tsai, 11F-2, No.43, Chai-I Street, Taichung City (TW)

( * ) Notice: Subject to any disclaimer, the term of this patent is extended or adjusted under 35 U.S.C. 154(b) by 0 days.

(21) Appl. No.: 10/104,550

(22) Filed: Mar. 25, 2002

(65) Prior Publication Data

US 2003/0178536 A1 Sep. 25, 2003

(51) Int. Cl.[7] ..... B65B 67/12

(52) U.S. Cl. ..... 248/97; 248/95; 248/149; 248/173; 403/109.3

(58) Field of Search ..... 248/97, 149, 172, 248/173, 95, 99; 403/109.3, 109.8, 109.7, 109.1

(56) References Cited

U.S. PATENT DOCUMENTS

| | | | | | |
|---|---|---|---|---|---|
| 128,073 | A | * | 6/1872 | Rossenborough, Jr. | 248/97 |
| 1,799,537 | A | * | 4/1931 | Schindler | 248/97 |
| 3,614,041 | A | * | 10/1971 | Koger | 248/97 |
| 3,771,752 | A | * | 11/1973 | Meeh | 248/98 |
| 4,157,801 | A | * | 6/1979 | Elmer | 248/97 |
| D260,475 | S | * | 9/1981 | Hall | D34/6 |
| 4,562,983 | A | * | 1/1986 | Klefbeck | 248/97 |
| 4,899,967 | A | * | 2/1990 | Johnson | 248/97 |
| 5,058,839 | A | * | 10/1991 | Stevens | 248/97 |
| RE33,842 | E | * | 3/1992 | Ebentheuer | 248/97 |
| 5,139,219 | A | * | 8/1992 | Navarro | 248/97 |
| 5,183,226 | A | * | 2/1993 | Brooks | 248/97 |
| 5,387,048 | A | * | 2/1995 | Kuo | 403/109.03 |
| 5,487,551 | A | * | 1/1996 | Kennedy | 280/47.19 |
| 5,556,063 | A | * | 9/1996 | Boyd | 248/99 |
| 5,781,964 | A | * | 7/1998 | Lin et al. | 16/113.1 |
| 5,803,299 | A | * | 9/1998 | Sealy, Jr. | 220/495.07 |
| 5,845,664 | A | * | 12/1998 | Ryder et al. | 135/65 |
| 6,079,894 | A | * | 6/2000 | Obitts | 403/109.3 |
| 6,164,607 | A | * | 12/2000 | Hawkes | 248/97 |
| 6,199,802 | B1 | * | 3/2001 | Scheibe, Sr. | 248/97 |
| 6,446,919 | B1 | * | 9/2002 | Tsui | 248/100 |

* cited by examiner

*Primary Examiner*—Leslie A. Braun
*Assistant Examiner*—Steven Marsh
(74) *Attorney, Agent, or Firm*—Charles E. Baxley

(57) ABSTRACT

A trash bag holder includes a base and a plurality of posts are pivotally connected to the base. A flexible ring is connected to respective second ends of the posts. The posts each includes an outer tube and a rod which is received in the outer tube. A trash bag is received in the space enclosed by the posts and the open top of the trash bag is folded outward onto the ring.

4 Claims, 7 Drawing Sheets

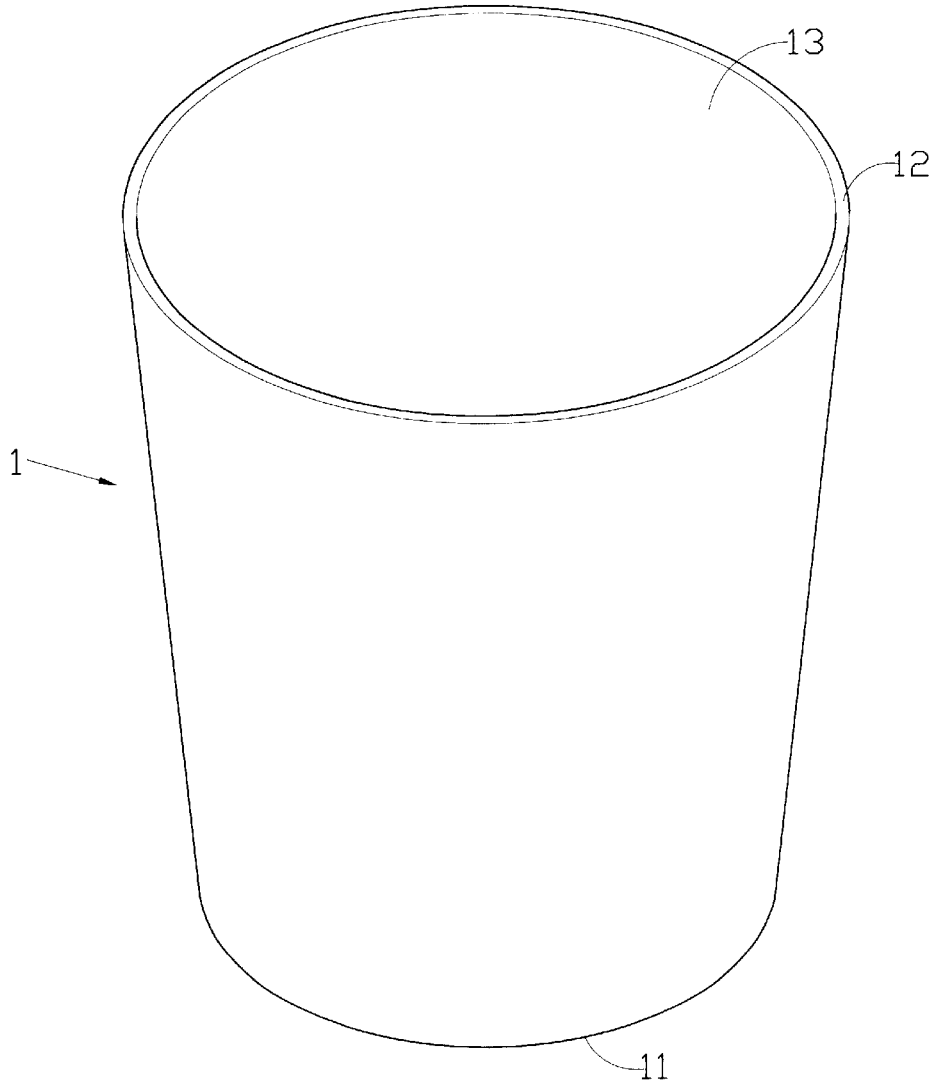
FIG. ONE
PRIOR ART

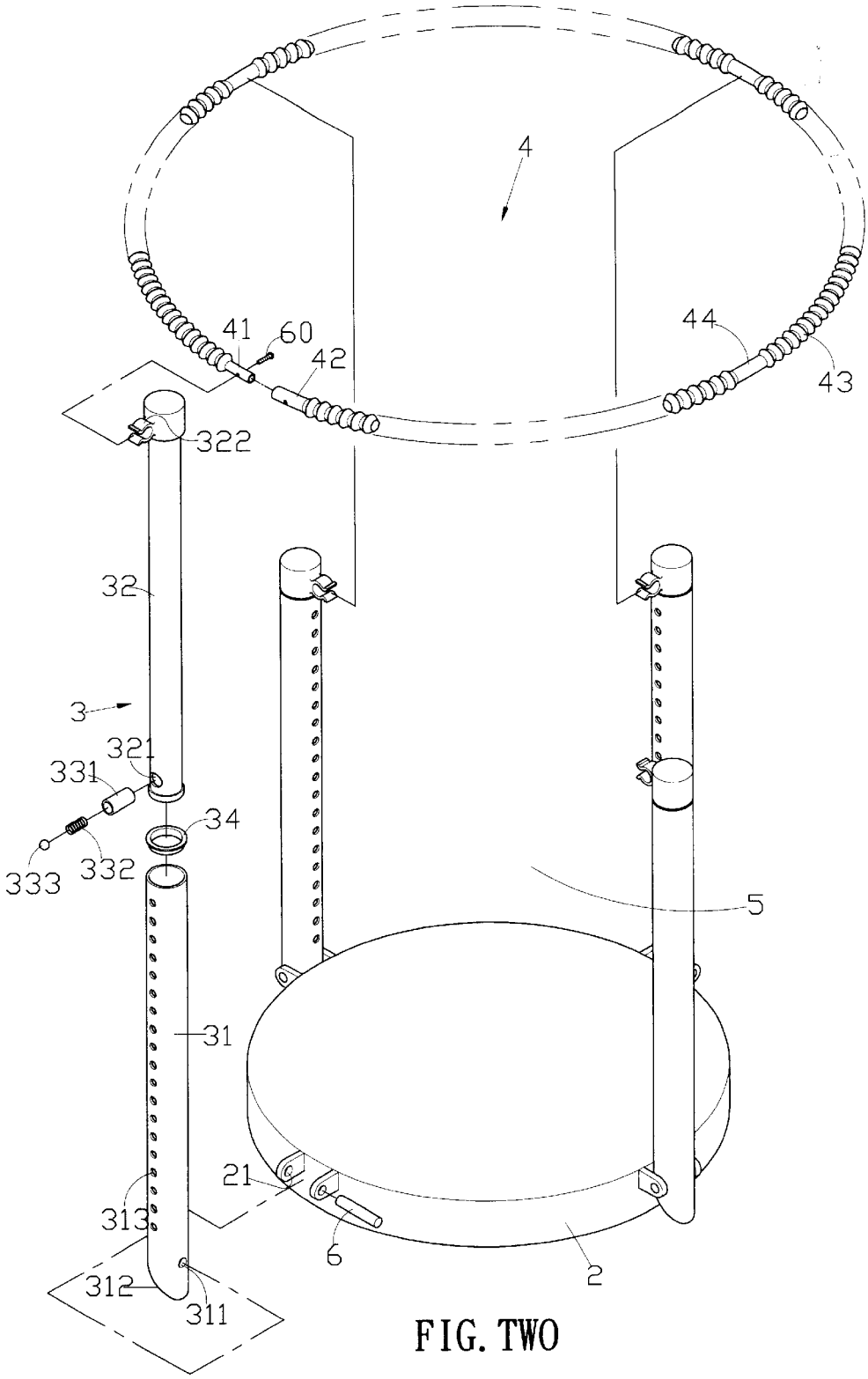
FIG. TWO

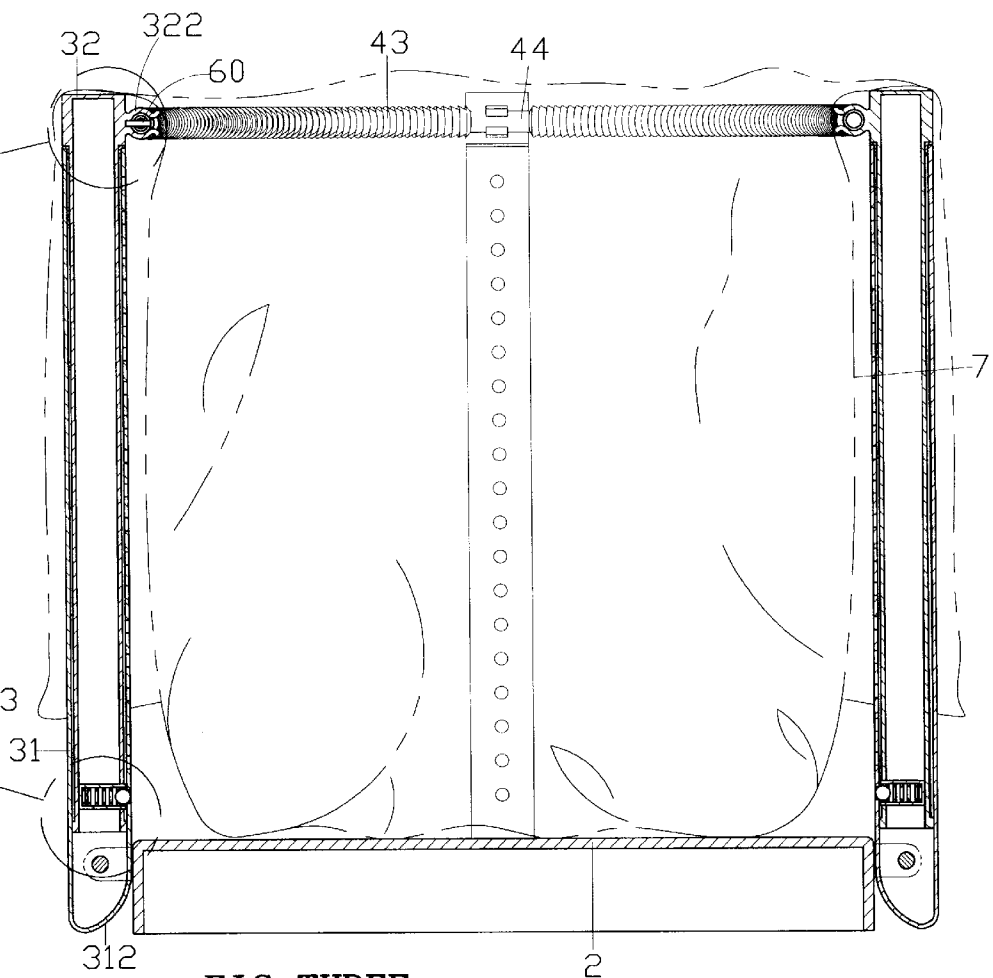
FIG. THREE
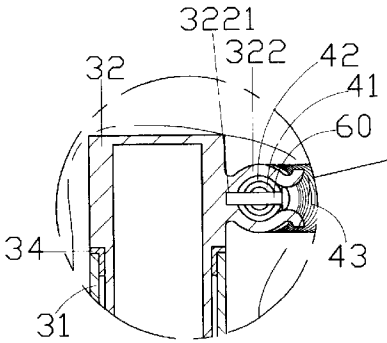
FIG. THREE-ONE
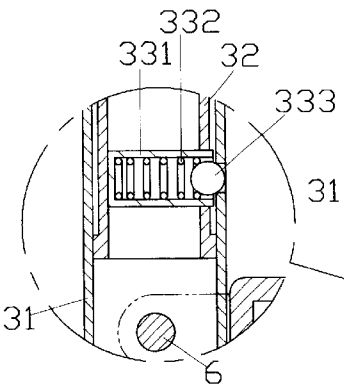
FIG. THREE-TWO

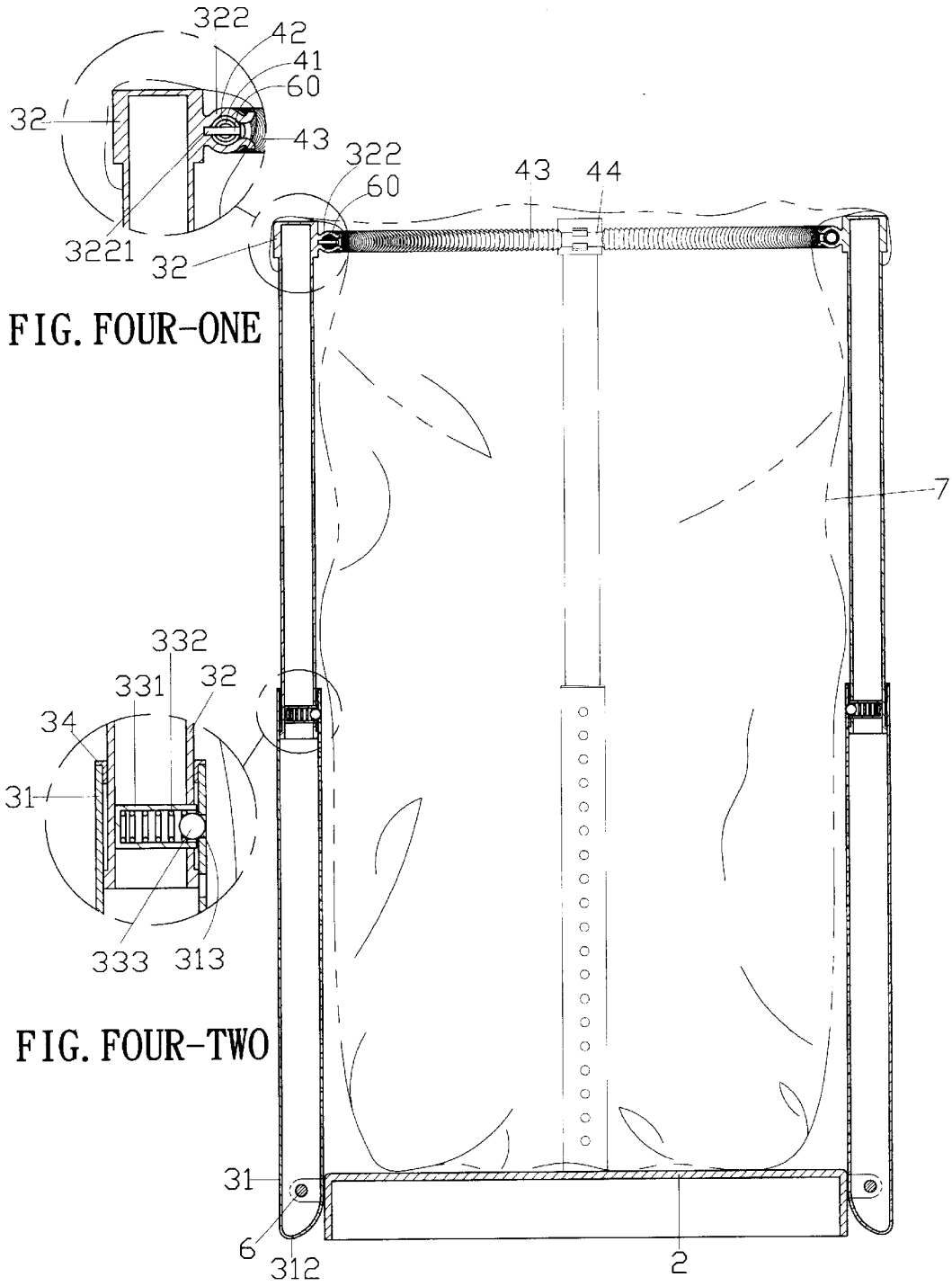
FIG. FOUR-ONE
FIG. FOUR-TWO
FIG. FOUR

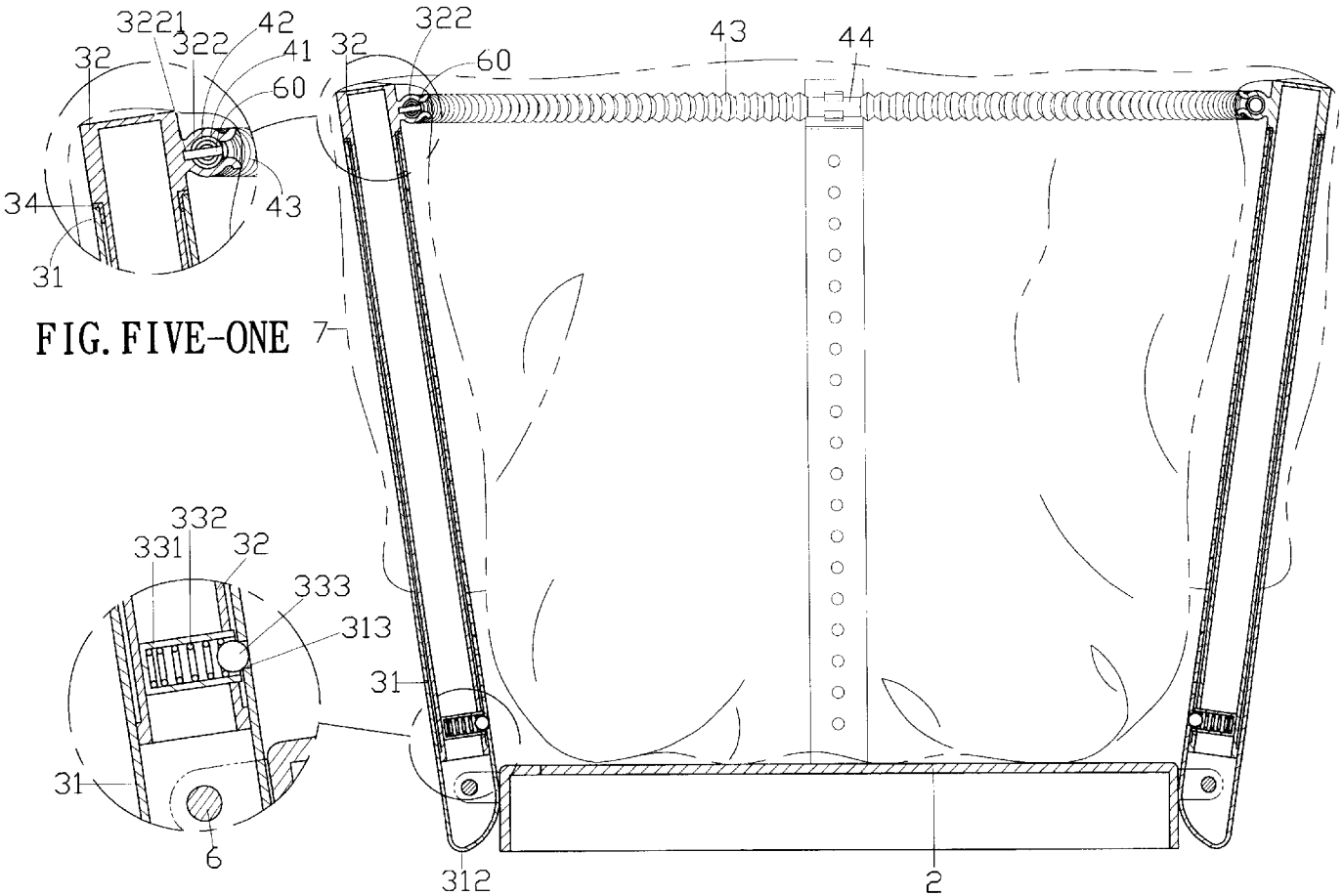
FIG. FIVE
FIG. FIVE-ONE
FIG. FIVE-TWO

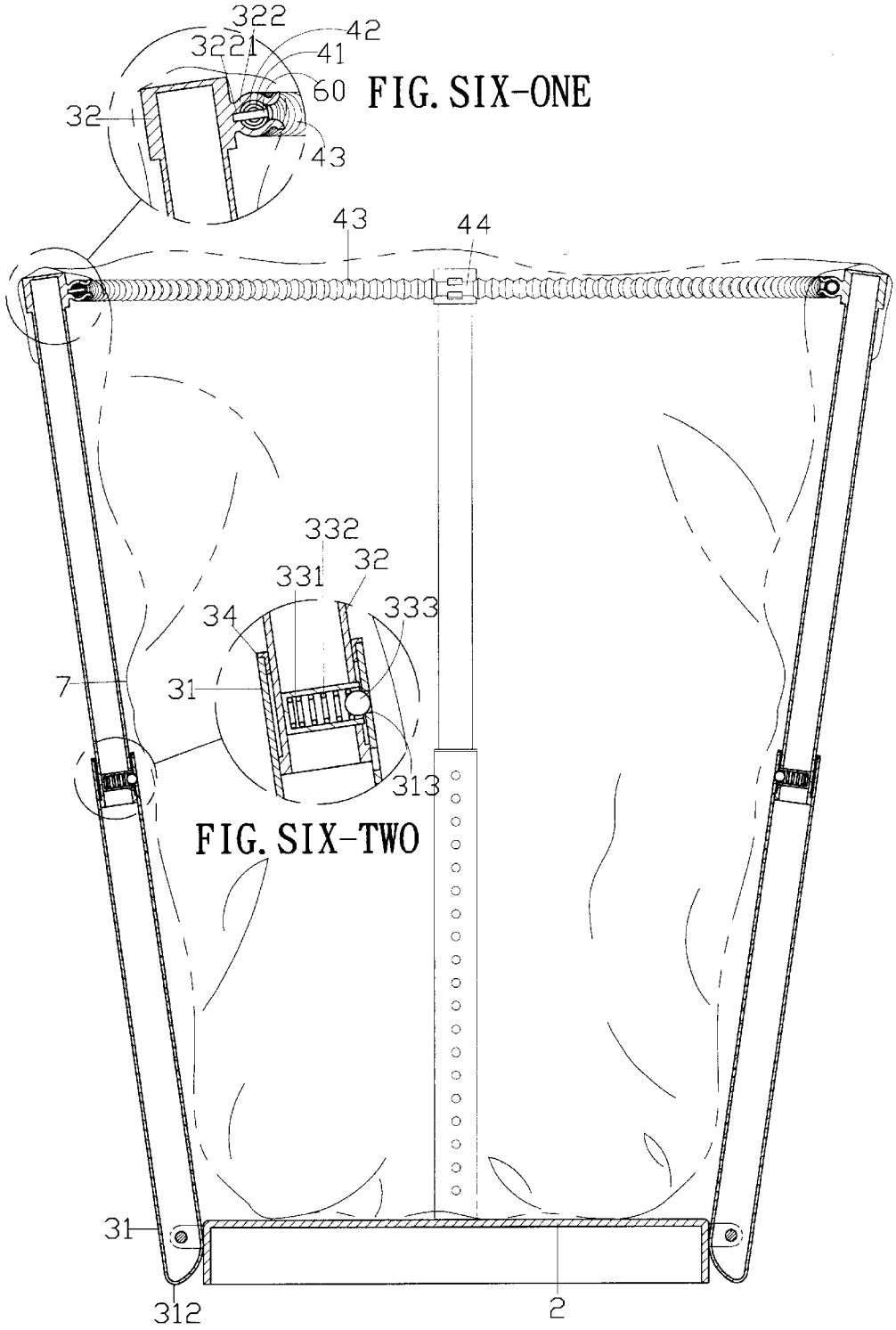
FIG. SIX

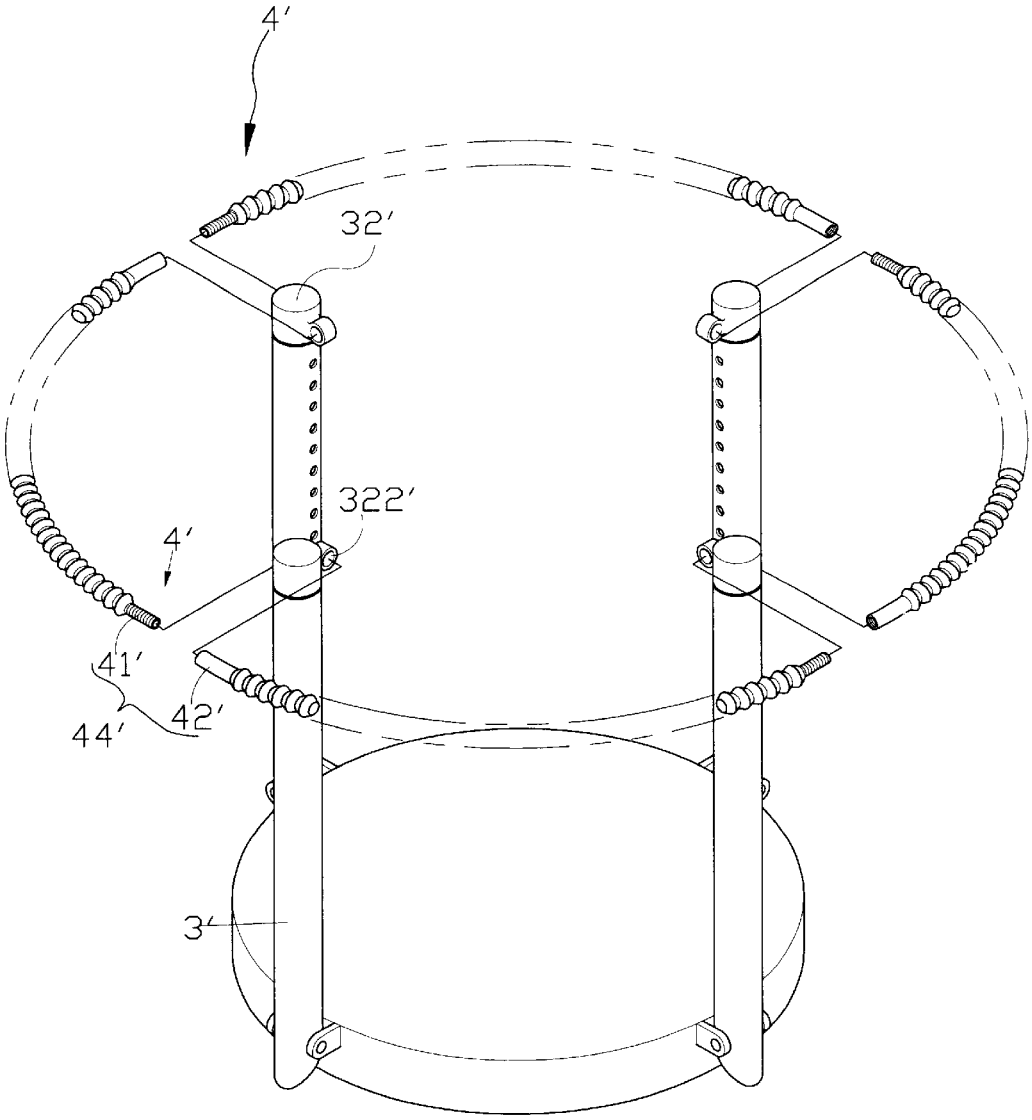
FIG. SEVEN

SIZE ADJUSTABLE TRASH BAG HOLDER

FIELD OF THE INVENTION

The present invention relates to a trash bag holder that has pivotable and retractable posts with a flexible ring connected to the posts so as to be cooperated with trash bags with different sizes.

BACKGROUND OF THE INVENTION

A conventional trash can 1 is shown in FIG. 1 and generally includes a bottom 11 with a peripheral wall 12 extending from the bottom 11. In order to keep the inside of the trash can to be clean, a trash bag is usually received in the interior 13 of the trash can 1. Garbage is discarded in the trash bag and when the trash bag is full, a new one is replaced. However, the user has to check the size of the trash cans he/she has and buy suitable trash bags which fit the trash cans. If the trash bag is longer than that of the trash can, only a portion of the volume of the trash bag can be used because portion of the trash bag located higher than the open top of the trash can cannot be well positioned. If the trash bag is shorter than that of the trash can, the opening of the trash bag cannot be engaged on the open top of the trash can and could be collapsed by the garbage.

SUMMARY OF THE INVENTION

In accordance with one aspect of the present invention, there is provided a trash bag holder which comprises a base with a plurality of posts pivotally connected thereto and a flexible ring is connected to respective top ends of the posts. A trash bag is engaged with a space enclosed by the. posts and the open top of the trash bag is folded outward on the ring.

The primary object of the present invention is to provide a trash bag holder wherein the height and the width of the open top can be adjusted.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is a perspective view to show the conventional trash can;

FIG. 2 is an exploded view to show the trash bag holder of the present invention;

FIG. 3 is a cross sectional view to show the trash bag holder of the present invention;

FIG. 3-1 shows the connection of the post and the bellow section;

FIG. 3-2 shows the engagement of the rod and the outer tube by the bead and the spring;

FIG. 4 is a cross sectional view to show the trash bag holder of the present invention wherein the height of the posts is extended;

FIG. 4-1 shows the connection of the post and the bellow section when the rod is extended;

FIG. 4-2 shows the bead positions the rod in the outer tube;

FIG. 5 is a cross sectional view to show the trash bag holder of the present invention wherein the top of the holder is expanded radially;

FIG. 5-1 shows the connection of the post and the bellow section when the bellow sections are expanded;

FIG. 5-2 shows the rod is positioned in the outer tube by the bead when the top of the holder is expanded radially;

FIG. 6 is a cross sectional view to show the trash bag holder of the present invention as shown in FIG. 4 wherein the posts are pushed outward by the garage in the trash bag;

FIG. 6-1 shows the connection of the rod and the bellow section when the bellow sections are expanded and the rod is extended;

FIG. 6-2 shows the rod is positioned in the outer tube by the bead when the top of the holder is expanded radially and the rod is extended, and FIG. 7 is an exploded view to show another embodiment of the flexible ring and the posts of the trash bag holder of the present invention.

DETAILED DESCRIPTION OF THE PREFERRED EMBODIMENTS

Referring to FIGS. 2, 3, 3-1 and 3-2, the trash bag holder of the present invention comprises a base 2 which has a plurality of pairs of lugs 21. A plurality of posts 3 each have a first end pivotally connected to the pairs of lugs 21 of the base 2. Each first end of the outer tube 31 has an inclined surface 312 and a passage 311 defined transversely therethrough. The first end of each of the posts 3 is then engaged with one of the pairs of the lugs 21 by a pin 6. The inclined surface 312 allows the posts 3 to be pivotable with respect to the pin 6 at an angle.

Each of the posts 3 includes an outer tube 31 and a rod 32 which is received in the outer tube 31. Each of the rods 32 has a recess 321 defined radially therein close to a lower end of each of the rods 32 and a sleeve 331 is received in each of the recesses 321 of the rods 32. Each of the sleeves 331 has a spring 332 received therein. A bead 333 is biased by the spring 332. Each of the rods 32 has a clip 322 located close to a top end thereof so that a flexible ring 4 is held in the clips 322.

Each of the outer tube 31 has a plurality of apertures 313 and the bead 333 is engaged with one of the apertures 313 so as to position the rod 32. A limit ring 34 is connected to a top end of each of the outer tubes 31 so as to avoid the rod 32 from being pulled out from the outer tube 31.

The flexible ring 4 includes a plurality of bold sections 44 and bellow sections 43. Each bold section 44 is connected by two end sections 41, 42 which are respectively connected to a bellow section 43. Each end section 41, 42 has a hole and a screw 60 extends through the two respective holes in the two end sections 41, 42. The screw 60 is further threadedly engaged with a recess 3221 (FIG. 3) in the rod 32 located between two parts of each of the clips 322. A trash bag 7 is received in the space 5 enclosed by the posts 3 and the open top of the trash bag 7 is folded outward on the ring 4.

Referring to FIGS. 4, 4-1 and 4-2, when the height of the posts 3 is to be increased, the user simply pulls the rods 32 upward to force the beads 333 to press the springs 332 till the bead 333 is engaged with desired aperture 313.

Referring to FIGS. 5, 5-1, 5-2, 6, 6-1 and 6-2, when the trash bag 7 is full, extra garbage may widen the ring 4 and pivot the posts 3 to allow more garbage to be put in the trash bag 7.

FIG. 7 shows another embodiment of the connection between the ring 4' and the posts 3' wherein each rod 32' has a ring member 322' for the bold section 44' of the ring 4' to be extended. The two end sections 41', 42' can be a threaded section and a tube with threaded hole for receiving the threaded section.

The height adjustable function of the trash bag holder of the present invention can be cooperated with any size of the trash bag and the pivotable posts and flexible ring 4 allow the trash bag to be expanded radially to receive more garbage.

While we have shown and described the embodiment in accordance with the present invention, it should be clear to those skilled in the art that further embodiments may be made without departing from the scope of the present invention.

What is claimed is:

1. A trash bag holder comprising:

a base;

a plurality of posts each having a first end pivotally connected to the base, each of the posts including an outer tube and a rod which is received in the outer tube, each of the rods having a recess defined radially therein and a sleeve received in each of the recesses, a spring received in the sleeve in each of the recesses and a bead biased by the spring, each of the outer tube having a plurality of apertures and the bead being engaged with one of the apertures, and a flexible ring connected to respective second ends of the posts.

2. The trash bag holder as claimed in claim 1, wherein the base has a plurality of pairs of lugs and the first ends of the posts are pivotally connected to the lugs.

3. The trash bag holder as claimed in claim 1, wherein each of the rods has a clip so as to hold the flexible ring.

4. The trash bag holder as claimed in claim 3, wherein the flexible ring includes a plurality of bold sections and bellow sections.

* * * * *